US007537111B2

(12) United States Patent
Hart et al.

(10) Patent No.: US 7,537,111 B2
(45) Date of Patent: May 26, 2009

(54) PAINT PARAPHERNALIA METHOD AND APPARATUS

(75) Inventors: Gregory R. Hart, Puyallup, WA (US); Dianna Kilponen, Lakewood, WA (US); John T. Eymann, West Vancouver (CA)

(73) Assignee: PacTech Investments, LLC, Lakewood, WA (US)

( * ) Notice: Subject to any disclaimer, the term of this patent is extended or adjusted under 35 U.S.C. 154(b) by 0 days.

(21) Appl. No.: 11/223,304

(22) Filed: Sep. 9, 2005

(65) Prior Publication Data

US 2006/0054527 A1 Mar. 16, 2006

Related U.S. Application Data

(60) Provisional application No. 60/608,633, filed on Sep. 10, 2004.

(51) Int. Cl.
*B65D 81/24* (2006.01)

(52) U.S. Cl. ..... 206/209; 206/361; 206/459.5

(58) Field of Classification Search ..... 206/209, 206/209.1, 361, 362, 372, 459.5, 534; 15/184, 15/247; 53/467–469, 473; 134/38; 383/42, 383/70

See application file for complete search history.

(56) References Cited

U.S. PATENT DOCUMENTS

| | | | | | |
|---|---|---|---|---|---|
| 160,567 | A | | 3/1875 | Bronson | |
| 2,004,320 | A | * | 6/1935 | Hanson | 206/209 |
| 2,533,829 | A | | 12/1950 | Merryweather | |
| 3,136,409 | A | | 6/1964 | Schumann | |
| 3,167,178 | A | | 1/1965 | Saunders | |
| 3,690,448 | A | * | 9/1972 | Switzer | 206/361 |
| 3,757,990 | A | | 9/1973 | Buth | |
| 3,905,476 | A | * | 9/1975 | Foreman | 206/361 |
| 4,334,416 | A | | 6/1982 | Turano | |
| 4,541,542 | A | | 9/1985 | Florentino | |
| 4,738,358 | A | | 4/1988 | Kehl | |
| 4,765,123 | A | | 8/1988 | Caldwell | |
| 4,802,576 | A | | 2/1989 | Kern | |
| 4,967,903 | A | * | 11/1990 | Kettle et al. | 206/209 |
| 5,032,188 | A | | 7/1991 | Kettle et al. | |
| 5,074,098 | A | | 12/1991 | Filipchuk | |
| 5,138,738 | A | | 8/1992 | Nicholson | |
| 5,174,445 | A | * | 12/1992 | Mull | 206/361 |
| 5,178,274 | A | | 1/1993 | Long | |
| 5,316,137 | A | | 5/1994 | Kyllonen | |
| 5,440,853 | A | | 8/1995 | Engdahl | |
| 5,533,617 | A | | 7/1996 | Von Flatern | |
| 5,540,363 | A | | 7/1996 | Wilson | |
| 5,553,701 | A | | 9/1996 | Jarecki et al. | |
| 5,629,058 | A | * | 5/1997 | Jones, III | 206/459.5 |

(Continued)

*Primary Examiner*—Luan K Bui
(74) *Attorney, Agent, or Firm*—Maier & Maier, PLLC

(57) ABSTRACT

What is provided is a protective environment for paint paraphernalia and wet paint being used in a painting process. Examples of paint paraphernalia includes paint brushes, paint rollers, paint trays, and paint cans. The protective environment in one form is a flexible polyvinyl chloride of at least ½ mil in thickness. The flexible polyvinyl chloride is arranged two provided a three sided connecting edge with the fourth side left unconnected for an opening into the interior portion of the protective environment. The protective environment is placed over the paint paraphernalia and marked with various paint paraphernalia characteristics to aide in the temporary storage and reuse of the paint paraphernalia during a painting job.

16 Claims, 6 Drawing Sheets

U.S. PATENT DOCUMENTS 5,709,301 A 1/1998 Couch et al.
5,887,708 A * 3/1999 Gonzales ..... 206/209
5,915,552 A 6/1999 Kim et al.
5,960,946 A 10/1999 Gramlich
5,966,772 A 10/1999 Woodnorth
5,966,902 A 10/1999 Korycki
6,450,336 B1 9/2002 Edes
6,530,470 B2 3/2003 Roundy
7,044,664 B2 * 5/2006 Papetti ..... 400/124.01
2005/0082197 A1 * 4/2005 Carol et al. ..... 206/575
2005/0145518 A1 * 7/2005 Hong ..... 206/361

* cited by examiner

PAINT PARAPHERNALIA METHOD AND APPARATUS

RELATED APPLICATIONS

This application claims priority benefit of U.S. Ser. No. 60/608,633, filed Sep. 10, 2004.

BACKGROUND a) Field

The following relates to preservation of paint paraphernalia including paint brushes, paint rollers, paint trays, and other instruments which utilize paint before, during and after a painting session. More particularly, the concept deals with lengthening the useful life of paint paraphernalia in combination with wet paint, preserving the paint from contamination and loss of moisture and keeping the paint apparatuses moist between painting sessions so as to minimize startup time and cleanup time.

b) Background Art

U.S. Pat. No. 6,530,470 (Roundy) discloses a convenient box preferably made of plastic that enables effective storage of a paint applying roller while the roller is wet with paint, the storage of the roller kept on a temporary basis.

U.S. Pat. No. 6,450,336 (Edes) discloses a protective painting utensil sleeve as discussed in column 3 at line 54. Essentially the painting utensil sleeve is a rectangular configuration with an open bottom. Further, the painting utensil sleeve is comprised of a sheath with a first panel and a second panel. Each panel has a first edge, second edge, a third edge, and fourth edge. There is a peripheral sidewall which extends between and is integrally coupled to the first, second, and third edges of each panel. An opening is defined between the fourth edges. This product is made of an elastomeric material. The sheath or sleeve itself comes in a packaging similar to, as referred to on line 19 in column 4, a conventional "condom package" in it's pre-used rolled up form. Further, to install the user unrolls the protective painting utensil sleeve over the bristles of the painting utensil. A shoulder comes into contact with the base of the painting utensil creating a seal to prevent airflow from drying the paint.

U.S. Pat. No. 5,966,902 (Korycki) discloses a paint roller cover container as discussed in column 1 at line 43, constructed with an upper and lower cover section joined along a common joint with a hinge and formed with a corresponding depression so that when the halves are closed on one another they define an elongated chamber of a size and shape to accommodate a paint roller. Further, the sections are molded as one piece of plastic material joined across a living hinge and are preformed to shape to accommodate a roller.

U.S. Pat. No. 5,966,772 (Woodnorth) discloses a paint roller and tray system as discussed in column 2 at line 11, the tray including a floor, a plurality of upstanding walls extending from the floor to form a basin and a partitioning wall configured for being removably positioned within the base and to create a first and second pans. The tray also has a first and second roller cover as discussed further in column 2 at line 21 which are axially spaced from one another so as to allow the rollers to independently rotate within the first and second pans.

U.S. Pat. No. 5,960,946 (Gramlich) discloses a modified paint roller tray having sides, a back wall, a front wall, and a two-part bottom. Further in column 2 at line 1, a pair of pivot points are attached to the back wall in order to secure the lid to the tray. Further down in column 2 at line 47, the lid can be made from the same type of material as the tray however it could be made from a different material for example the tray could be made from metal and the lid made from plastic.

U.S. Pat. No. 5,915,552 (Kim) discloses a paint roller protective device with an elongated shell including an end wall, sidewalls, an open end for receiving the roller, and a closed end, as well as a cap to seal off the open end.

U.S. Pat. No. 5,887,708 (Gonzales) discloses a paint tray cover as discussed in column 3 at line 56, including a bag for receiving the paint tray, the bag having an open end and fabricated of plastic material. The bag is chemically resistant to withstand prolonged contact with latex or oil-based paints. The bag also has upper surface and a lower surface and a hollow interior. The lower surface has a pair of holes in a spaced relationship dimensioned to receive the paint tray feet. The open end of the bag is pinched together so that the second and third pair of holes are in alignment under the front edge of the paint tray. Further in column 3 at line 18, the bag is positioned over the paint tray and user then fills the tray with paint as usual. Paint causes the plastic of the bag to conform to the bottom of the tray. Further at line 27, the bags can also be used to wrap up the roller covers and brushes and keep them from drying out overnight.

U.S. Pat. No. 5,709,301 (Couch) discloses a storage device for paint rollers, paint roller covers, and paint brushes. The storage device is a cylindrical container having a lid, which is flared out at the upper portions and has a foam insert at the bottom for forming a spongy seal with the paint implement. The container has a core around which the roller cover fits. The lid can be either a screwdown or friction fit lid, and has a foam insert on its underside to form a spongy seal with the upper part of the roller cover.

U.S. Pat. No. 5,553,701 (Jarecki) discloses a paint tray assembly consisting of a paint tray and a separate cover which is attached to and removed from the tray by meeting peripheral ribs on the underside of a lid and the top tray edge. This paint tray and lid combination are composed of rigid plastic materials or the like.

U.S. Pat. No. 5,533,617 (Von Flatern) discloses a storage container for a paint roller sleeve and has a flexible resilient tubular housing for removably storing the sleeve.

U.S. Pat. No. 5,540,363 (Wilson) discloses as discussed in column 1 at line 57 a rectangular shaped rigid container for temporary storage of a wet paintbrush, where the container has two parts separated about the rectangular perimeter and an opening is formed in the top walls of the two parts to allow a paintbrush handle to pass through the opening. Further at column 2 line 1, the closed cell foamed material is compressed around the handle to seal the container about the paintbrush. Also at line 22, a hinge is associated respective to each of the cover members so that they can close in a clamshell type fashion around the paintbrush.

U.S. Pat. No. 5,440,853 (Engdahl) discloses a rigid plastic cylindrical tube as referred to in column 1 at line 50, whose open distal end is closed and sealed by a plastic distal end cap.

U.S. Pat. No. 5,316,137 (Kyllonen) discloses a rigid paint roller tray and lid having a seal for resealable airtight mating of the tray with the lid.

U.S. Pat. No. 5,178,274 (Long) discloses a rigid paint roller holder container with two parts, the container and a snap on lid. The container has four molded elements including a recessed support for the paint roller handle, two post supports for supporting shorter paint rollers, a support for longer paint rollers, and grooves for the snap on lid.

U.S. Pat. No. 5,138,738 (Nicholson) discloses a coating applicator having a bag detachably mounted on a paint brush head and covers the entire fiber portion of the paint brush. The bag is close fitting and conforms to the outline of the paint brush fibers. A drawstring, Velcro fasteners, or elastic bands allow the bag to be mounted to the paint brush head. The bag as discussed in column 5 at line 33, has a rolled edge or partly rolled with an angular ring of absorbent material covered by the rolled edge. The material for the bag can be a woven, knit or felt cloth and may be fine, course, thick or thin. The coating applicator is applicable for painting, but also renders paint brushes suitable for applying stains, varnishes and the like.

U.S. Pat. No. 5,174,445 (Mull) discloses a paintbrush storage bag assembly for storing a paintbrush in a storage liquid between uses and also holding the brush while in use. As discussed in column 3 at line 7, the brush is positioned in a heavy foil bag which is pleated and tapered to provide a relatively large base. The liquid in the bag provides ballast to prevent tipping. The foil from the bag is similar to that in which vacuum packed coffee is sold. Further at line 20, the pleats of the bag are secured together by complementary look and loop fastener members. The bristles of the brush are sealed in the bag by a large wide elastic band such as a rubber band. The band is secured onto the brush around the ferrule or top portion of the bristles, in a tensioned condition. The band rolls down and tightly seals the sides of the bag and prevents spillage during operation.

U.S. Pat. No. 5,074,098 (Filipchuk) discloses a container for storing a wet paint roller comprised of a cylindrical sleeve with two end caps.

U.S. Pat. No. 5,032,188 (Kettle et al.) discloses a sealed sachet constructed of a material substantially impermeable to air and water into which the brush head can be inserted immediately after use without any prior cleaning, the sachet containing a small quantity of brush preservative or cleaning liquid to prevent any paint remaining on the bristles from drying or hardening. The sachet is sealable around the brush handle, or is provided with means for sealing the open mouth of the sachet around the handle to restrict air into the sachet. In column 5 at line 18, the sealed sachet comprises two multiple lamina, paper laminar layer and a plastic foil laminar layer, such as is commercially available for variety of different purposes in the packaging art. The layers are heat sealed one to the other around the periphery to form a sealed sachet containing a small quantity preservative liquid. At line 25 the inner surfaces of the sachet are metal foil, the outer layers are paper or plastics and suitable for printed advertising matter or instructions or both.

U.S. Pat. No. 4,967,903 (Kettle) discloses essentially the same subject matter as the kettle '188 patent, with variations in the claims.

U.S. Pat. No. 4,802,576 (Kern) discloses a waffle iron looking device or storage container for a paint roller including a housing with a recess for the paint roller and a roll of foil to provide a form of hermetic sealing.

U.S. Pat. No. 4,765,123 (Caldwell) discloses a process for covering a paint tray so that it may be reused without the necessity of cleaning. As discussed in column 2 at line 9, the flexible paint impervious bag has an opening with a girth sufficiently large fit over the floor end of the paint tray. The girth is sufficiently large so that the bag in addition to fitting over the floor end is also large enough so that it lies down into the floor of the tray against the inner surface of the sides. Paint can be held within the tray and along the outer surface of the bag, allowing the tray to be used in a conventional manner but avoiding the necessity of cleaning the tray.

U.S. Pat. No. 4,738,358 (Kehl) discloses a paint roller cover container and extractor assembly simplifying the cleanup process. As discussed in column 2 at line 25, the container is preferably made of a polymeric plastic, and is generally cylindrical and shaped as a hollow tube having a closed bottom and an open top.

U.S. Pat. No. 4,541,542 (Florentino) discloses a paint tray cover as discussed in column 2 at line 23, containing a surface with a spatial protrusion to accommodate a paint roller brush handle. The cover is made of a flexible semi rigid material, such as polyethylene which will allow a snug airtight fit over a conventional paint tray. The spatial protrusion is preformed as a wedged shaped cavity.

U.S. Pat. No. 4,334,416 (Turano) presents an apparatus for soaking and preserving paint roller cover sleeves having an open top receptacle with bottom and side walls for holding a quantity of solvents, and a removable cap for sealing the open top portion of the container together with a post having an enlarged foot at the bottom for engaging the inside bottom of the receptacle to support the post in an upright position.

U.S. Pat. No. 3,960,448 (Switzer) discloses a brush storing bag which is easy to open and close, and permits the user to hang and suspend the brush in the bag on a hook. Further in column 1 at line 48, the bristles of the paint coated brush are closed in a sheet of plastic that is a wrapper which can be conveniently cut from a suitable sheet of sheet plastic and which is placed in position on the brush and held for removal for the rubber band or similar. Referring to column 2 at line 58, the protecting bag has a front wall and a back wall with their longitudinal edges integrally joined at the upper transverse edges as well as at the lower transverse edges, the joining is by heat sealing. The top edges are left unsealed for insertion of the entire paintbrush into the bag.

U.S. Pat. No. 3,757,990 (Buth) discloses a flexible liner for protecting a paint tray and a mechanical means for removing the flexible liner to the tray. The clips for clamping the liner to the walls of the tray act as the mechanical means, or a resilient band/drawstring or adhesive can be used to fix the liner to the tray.

U.S. Pat. No. 3,167,178 (Saunders) discloses a paint brush wrapper where as discussed in column 1 line 45 an envelope has two sides and is preferably made of plastic material. The envelope is of substantially rectangular configuration and has four edges. Each of the four edges are joined along the other to form the envelope. The first opening is formed in the envelope along one of the edges and is substantially long enough to admit the bristles of the brush and the handle in the longitudinal direction of the handle. The flap as discussed on column 2 line 11 is formed with the envelope, extends from the side, along the edge and is adapted to fold and close the opening. A snap is provided to secure the flap to the side of the envelope.

U.S. Pat. No. 3,136,409 (Schumann) discloses a package and reusable receptacle for paintbrushes. The receptacle is formed of a flexible and transparent polyvinyl sheet. It has a back panel and a shorter front panel with the longitudinal edges of the two panels united and heat sealed. Back panel is folded at the upper edge of the package and merges into a downward extending flap with a rounded edge which overlaps the upper portion of front panel. A snap is arranged to connect the flap and the back panel.

U.S. Pat. No. 2,533,829 (Merryweather) discloses a bag adapted to removably receive and store a paintbrush, or the like, in substantially fluid tight condition. In column 2 at line 37 a bag portion made in a substantially rectangular shape within open-end, is made of two flexible pieces of sheet material which are sealed or otherwise secured together around the edges. In column 3 at line 7 secured to the bag, near the top is a fastener which is comprised of a round metal snap of the button type and a cord which wrapped around the open top portion of the bag, sealing the bag tightly around the paintbrush handle, as well as providing an end loop to hang the paintbrush and bag from a hook.

U.S. Pat. No. 160,567 (Bronson) discloses a paper broom bag or case having four sides and an equal number of corners, the lower end of the case is open so that it may be passed over the broom handle and thence over the broom head, and the case is provided with a strengthening cord and attached to the lower at the bag, to bring the sides together and bind them so that the upper opening of the bag is to a size nearly if not quite equal to that of the handle.

SUMMARY OF THE INVENTION

An object of this concept is to provide a containing structure composed of a material which can contain and preserve surface treatment liquids such as wet paint, varnish, glue, and other surface treatment finish applications which have a liquid or semi-liquid state for application and which harden into a solid or semisolid state after application. Generally the types of industries which use these surface treatment products include the construction industry, the manufacturing industry, the military, the arts and crafts industry, the automotive industry and the aeronautical or naval industries. The types of surface treatment applications which are generally used include for example in the construction industry, paint, primer, varnish, glue for wallpapering, and other adhesive-type materials which have a liquid phase during the application state. Other more industrial-type uses which include the automotive industry, aeronautical and naval industries, and transportation industries may use methyl or ethyl-based surface treatment application products, or may use a zylene or acetone-like applicant which have high corrosive properties. Nonetheless, a common theme runs throughout all of these industries when using the surface treatment application during the "building" process. That is the process for applying and reapplying various surface treatment finishes requires a time period of adhesion or drying of the surface treatment application prior to taking the next step. Additionally, these industries and sub industries are often interrupted during the application process and thus coordination of the surface treatment materials such as the paint, the varnish, the primer, type of location to be applied, and other factors make coordination of this process somewhat like a "symphony" which requires advanced planning and detailed organization.

Thus the material containing the surface treatment application in its pre-applied state may need to be anticorrosive, or have the ability to contain the application such as the wet paint in stasis, keeping the evaporation rate to relatively nominal amounts and preserving the applicator or the paint from contamination and loss of moisture. The containing structure will have memory fields which enable the user to encode the particular characteristic properties of the surface treatment application contained within the containing structure for later use as well as continuity between painting or treatment sessions. By way of example, one form of the containing structure is a polyvinyl chloride which has a wall thickness of approximately two mil, and can be utilized to act as a protective environment for paint applicators such as paint brushes, paint rollers, paint guns, paint trays, gallons of paint from at least ½ gallon to 5 gallons, and other paint paraphernalia used during the painting of an interior or exterior surface. Additionally, in lieu of polyvinyl chloride other forms of materials can be used which have anticorrosive properties to contain the paraphernalia which is used during an industrial application. An alternative embodiment of such a material might be a two-ply or two-layered material including an inner layer having anticorrosive inner shell capabilities such as aluminum foil lined with an outer layer having the desired printing capabilities for the required property or characteristic memory.

In the preferred embodiment, the containing structure comes in various sizes including one large enough for encompassing a paint tray, other sizes can encompass multiple brushes, and still other structures large enough to encompass a tray with a paint roller and multiple brushes. Additionally, the containing structure is alternatively configured to encompass just the roller shaft of a paint roller.

In keeping with another objective of the present concept, the containing structures or paint applicator containers can be sealed so that paint vapor does not readily escape from the enclosed environment. This sealing enables the paint applicator to contain the existing wet paint and stay reasonably hydrated so that the paint itself does not dry and harden within the applicator making a brush or a paint roller useless.

Additionally another objective of this concept is for coordination and organization of the paint tools such as the paint brush, paint gallons, and other items which may be used in a certain location within the painting of a large structure, or which may be transported from one location to another. During this staging process, the paint applicators or tools may need to be labeled with the correct paint specifications such as the gloss and finish or the type of chemical composition of paint, or the color of the paint itself so as to avoid loss of time and materials. Further, a temporal co-ordination field is provided on the paint applicator structure so that dates of usage can be tracked and organized so the painters who may be using the paint items can adequately coordinate and document the various stages of the paint process and pick up where they may have left off.

In light of these and other objects which have been previously mentioned, a discussion of the preferred embodiment will now be provided.

DETAILED DESCRIPTION OF THE PREFERRED EMBODIMENTS

Figure 1:
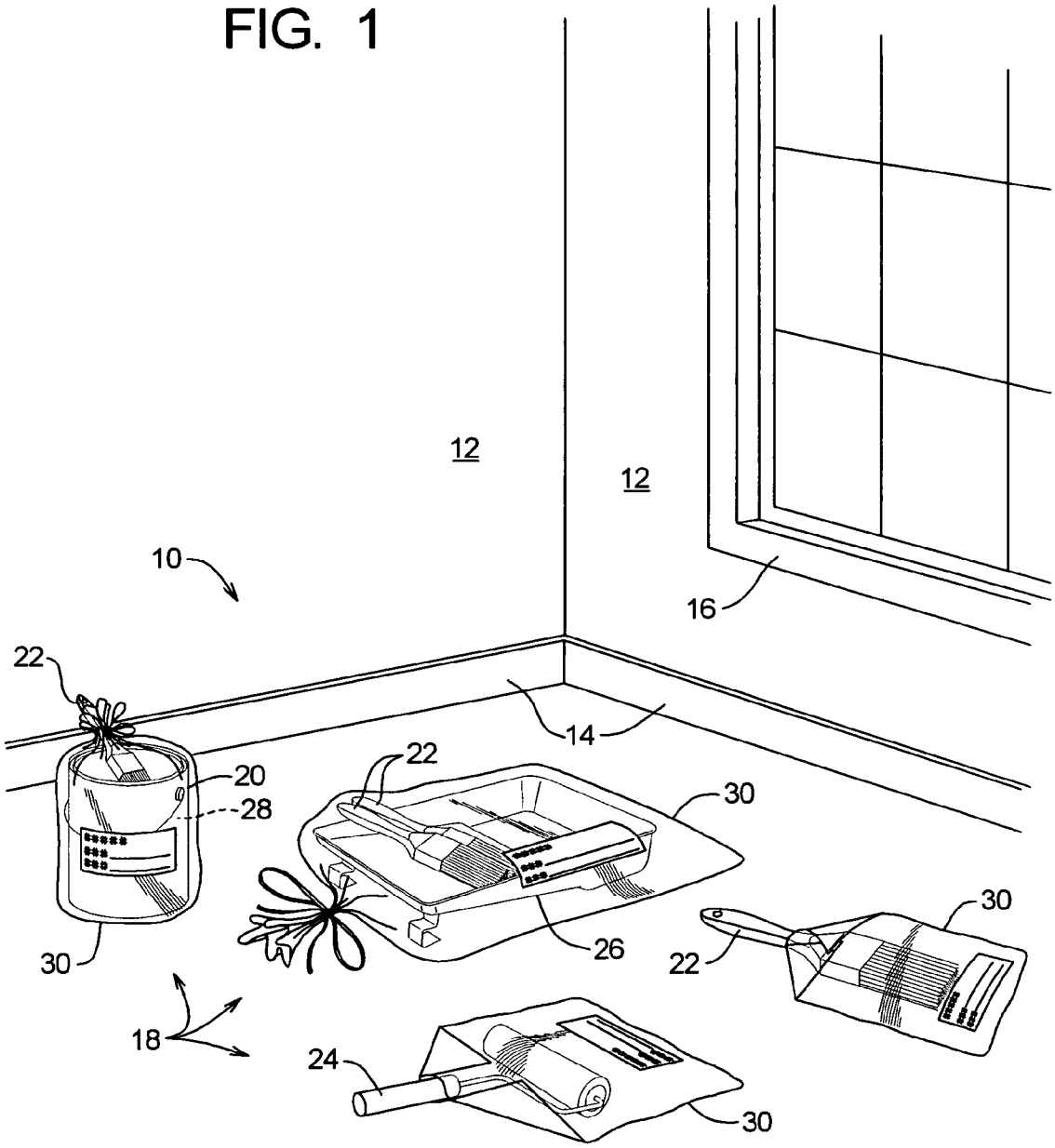
FIG. 1 is an isometric view of a typical painting environment.

Referring to FIG. 1, the present embodiment deals with a problem which has plagued professional and amateur painters alike for many years: how to keep the paint or other surface treatment application being utilized in a painting environment fresh and uncontaminated between long periods of non-use.

The nature of surface treatment applications and painting in particular is such that many times when painting an existing surface or a new surface, multiple coats of paint including primer, varnish, or a base coat of paint with additional layers of paint need to be added onto the painting surface to accomplish the desired effect. Prior to adding a second or third coat of paint, the first coat must dry. This drying process can take between three to twenty-four hours depending on the paint specifications and volumetric flow rate of fresh air coming into contact with the applied wet paint to promote evaporation and drying of the surface. This paint drying process problem is endemic with any type of surface treatment application such as painting on walls, furniture or artwork.

After a treatment or painting session or at the end of the day, the painter might need to clean the painting utensils or painting paraphernalia being utilized during the paint job, this adds labor time to the painting job.

In addition, meeting the required OSHA standards, for disposal of contaminants or environmentally unsafe materials can be especially costly. Thus a fast and efficient way to clean up the unused surface treatment applicator and application such as paints and paint brushes reduces a measure of risk and increases the job completion efficiency.

If the paint job is being performed by a commercial painter, it is likely that the commercial painter needs to move between paint jobs in various stages of completion, and thus the commercial painter may not return to the job site to finish painting the second or third coat until many days or possibly even a week later.

A well orchestrated painting job is like a symphony where the instruments must be organized and categorized for their desired application and purpose. The painter can efficiently increase production if he does not have to clean the existing painting instruments or paint applicators including paint brushes, paint trays and paint rollers between paint sessions.

Further, many times the same color paint will be used for a particular painting job or painting session. Consequently, many of the paint applicators or painting paraphernalia will contain the same color paint. Knowledge of the paint type associated with a particular paint applicator can be beneficial to the painter's level of the efficiency.

Also what may occur is that different shades of paint may be used within the same painting environment but the shades may not be distinguishable to the naked eye in the wet paint state. Again, knowledge of the various shades of paint associated with the paint applicators utilizing the shades can increase the painter's level of efficiency.

Another problem may arise when the same color paint is being used but where the finish of the paint is different. For example, instead of a semi-gloss white paint being used on the wall, a satin white paint might be used on the molding. Further, different paint styles for interior or exterior uses may need to be distinguished between the various paint applicators containing them.

Problems arise when the paint leaves the paint can which has the paint specifications and characteristics. Distinguishing between unidentified wet paints being used in the same painting session can be difficult and potentially costly especially when the unidentified paints may have similar colors but different finishes or other characteristics. The wrong paint might be used on the wrong surface, thus costing significant material cost and labor time. The paint might also need to be disposed of if the paint cannot be traced back to its original specification on the paint can, thus leading to a potentially damaging misuse of labor.

During or after a painting session, the paint applicators or paraphernalia may be moved within a job site and when a new paint session resumes, there may not be a clear connection between the painting environment and paint applicators, thus causing confusion as to what applicator should be used in the particular painting environment.

A discussion will now be provided where the current embodiment is used to coordinate and preserve paint and paint paraphernalia during a construction painting session. It should be kept in mind that the current embodiment can be utilized in other industries as previously discussed such as the automotive industry, the manufacturing industry, the aeronautical industry, the Marine or naval industry, the arts and crafts industry and other areas which have the need of surface treatment application over a long extended time-frame.

Referring to FIG. 1, a painting environment 10 is shown where the painting environment is a room which is currently being painted. In the current painting environment 10, the walls 12, the molding 14 as well as the window casing 16 have all been painted. Various painting paraphernalia or paint applicators 18 have been used to apply the paint to the painting environment 10.

The paint applicators include the paint can 20, the paint brushes 22, the paint roller 24, and the paint tray 26. The paint 28 is contained in the paint can 20. The paint can can generally come in various sizes including ½ gallon to 5 gallon volumes.

As it can be seen in FIG. 1, the paint applicators 18 have been grouped together within the painting environment 10. The paint applicators 18 have each been covered or contained in a protective environment 30.

The painters have left the paint applicators 18 in a state of use just after finishing the current painting session. This means that the paint 28 which was poured from the paint can 20 into the paint tray 26 and then applied to the walls 12, molding 14 and casing 16 by using the paint brushes 22 and paint roller 24 is still wet as utilized on the paint brushes 22, paint roller 24 as well as being held within the paint tray 26 and the open paint can 20. No cleaning of the paint applicators 18 was required prior to the painter's leaving the painting session. The only work completed was the insertion of the paint applicators 18 into the various protective environments 30.

Figure 2:
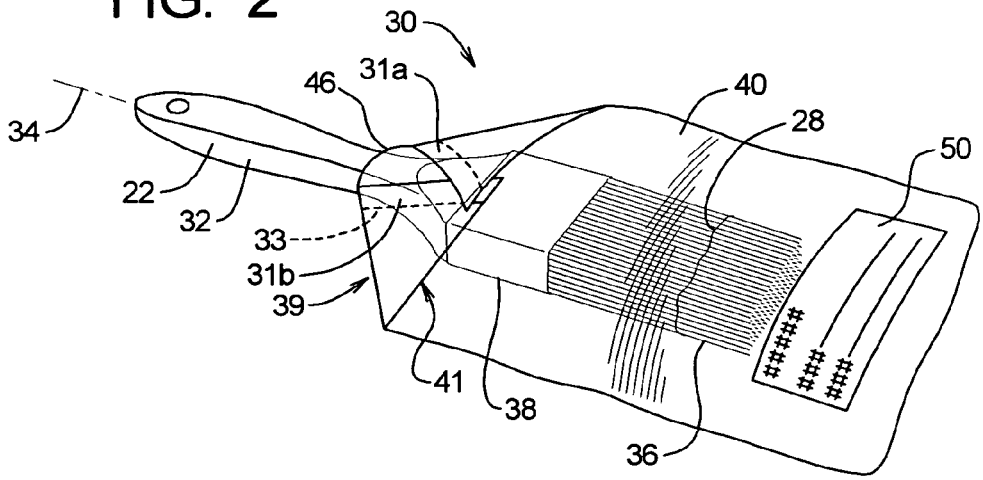
FIG. 2 is an isometric view of a paint brush having wet paint on the bristles and contained within a typical protective environment.

Referring to FIG. 2, a typical protective environment 30 is shown surrounding a wet paint brush 22. The paint brush having a handle 32 arranged along a longitudinal shaft or axis 34 with the handle 32 being at the rear end of the paint brush and the bristles 36 being at the front end of the paint brush 22. Approximately midpoint along the paint brush longitudinal axis 34 the handle 32 ends at the ferrule 38, which is shown as a stainless steel or non-corrosive alloy sheet metal having four sided rectangular surface area structure to contain the bristles 36 in the desired rectangular shape.

As mentioned before, it is desirable to keep the paint brush bristles 36 wet with the paint 28 so that painting can resume with the pre-prepared paint 28.

Consequently, the protective environment 30 in the current embodiment is provided as a highly flexible translucent or transparent material with a containing structure 40.

Figure 4:
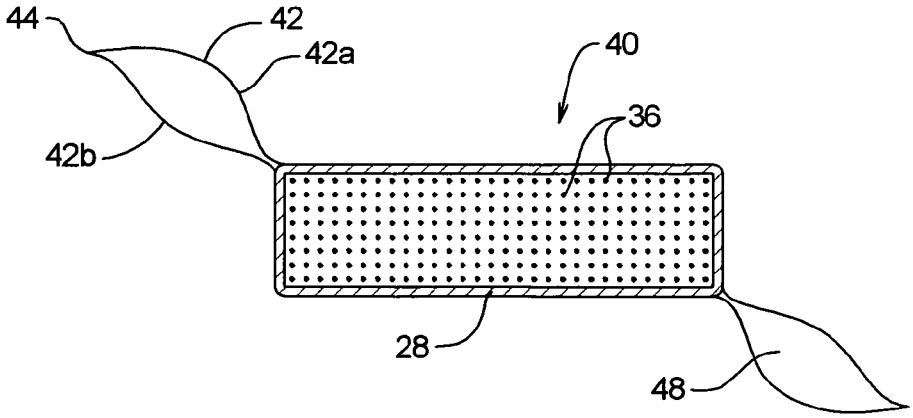
FIG. 4 is a cross-sectional view of a wet paint brush as shown in FIG. 2, with the protective environment surrounding the paint brush bristles.

Referring to FIG. 4, the containing structure 40 is comprised of a containing wall 42 constructed of a polyvinyl chloride and less than ½ mil having a thickness not less than ½ mil but as shown in this embodiment as a thickness of 2 ml. The containing wall thickness is provided to allow the containing structure to easily configure to the shape of the paint brush bristles 36 or the other contained painting applicator 18. Attached to the paint brush bristles 36 is the wet paint 28. The wet paint 28 has a viscosity substantially strong enough to adhere the containing wall 42 of the containing structure 40 to the surface area of the wet paint 28 attached to the paint brush bristles 36. In application, the user will insert the containing structure 40 over the paint brush 22, and press the containing structure 40 against the wet paint 28 contained on the paint brush 22, thus providing a nearly fully hermetically sealed environment around the paint brush 22.

Alternatively, the containing structure 40 may be composed of a saran wrap-type material which is provided in a sheet like configuration, where the painting applicator 18 can be placed in, for example the center or middle upper half of the rectangular sheet like configuration, and the bottom half of the rectangular sheet like configuration being folded over to create a semi-contained enclosure. The inside face of the sheet like saran wrap material may have somewhat of an adhesive backing which when the user presses his or her finger around the perimeter of the paint applicator creates a semi permanent seal reducing the evaporation rate. On the outside of this sheet like containing structure would be the various paint applicator and paint characteristics as will be further discussed below.

Still referring to FIG. 4, as discussed above, the main problem with keeping the paint applicator 18 wet with paint 28 and so that the paint applicator 18 does not dry out, is the molecular evaporation rate caused by the escape of water molecules in vapor form over a period of time such as three to twenty-four hours. By applying the containing structure 40 which is essentially a thin membrane impermeable to the transfer water vapor, the evaporation rate of the water molecules contained within the wet paint is greatly reduced and for all intensive purposes is essentially zero. Without the containing structure 40 in place, the evaporation rate would occur over a timeframe of hours, with the containing structure 40 in place, the evaporation rate is prolonged over a timeframe of days or weeks depending on the gas permeability of the membrane 40 or containing structure. In the current embodiment, the gas permeability of the containing structure membrane 40 cuts down on the evaporation rate for a matter of multiple weeks and some tests have shown even multiple months. Therefore, the paint contained within the protective environment 30 stays hydrated with water and does not dry out.

The containing structure 40, in the current embodiment, is comprised of two containing wall's 42, a front wall 42*a*, and a back wall 42*b*. The front wall and back wall meet along a connecting edge 44. The flexible containing structure 40 is configured in a generally rectangular shape, but other containment shapes are conceived. These include round, semi-spherical, trapezoidal, and other functionally relevant shapes. In the current embodiment, the front wall 42*a* and back wall 42*b* are essentially coplanar and the connecting edge 44 runs along three of the sides of the rectangular shape. The fourth side is not connected. This open fourth side is considered generally an insertion opening 46 through which the painting apparatus 18 such as the paint brush 22 can be inserted.

Figure 2A:
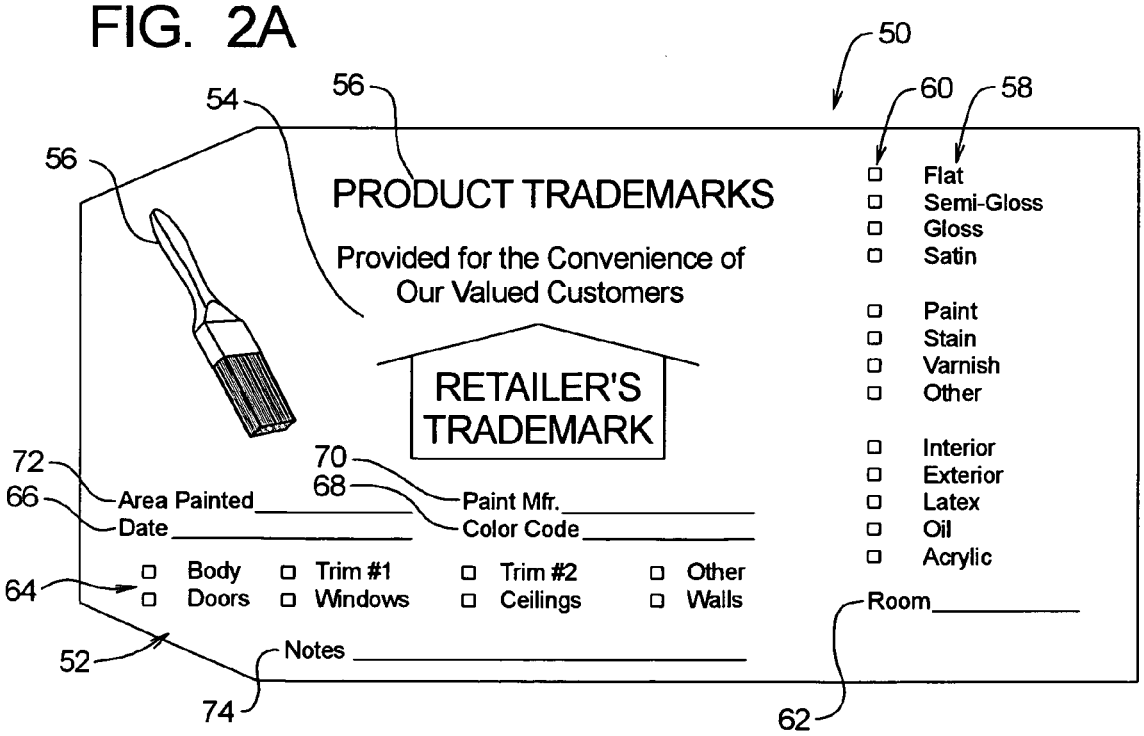
FIG. 2A is a plan view of the identification system for recording the painting characteristics.
Figure 2B:
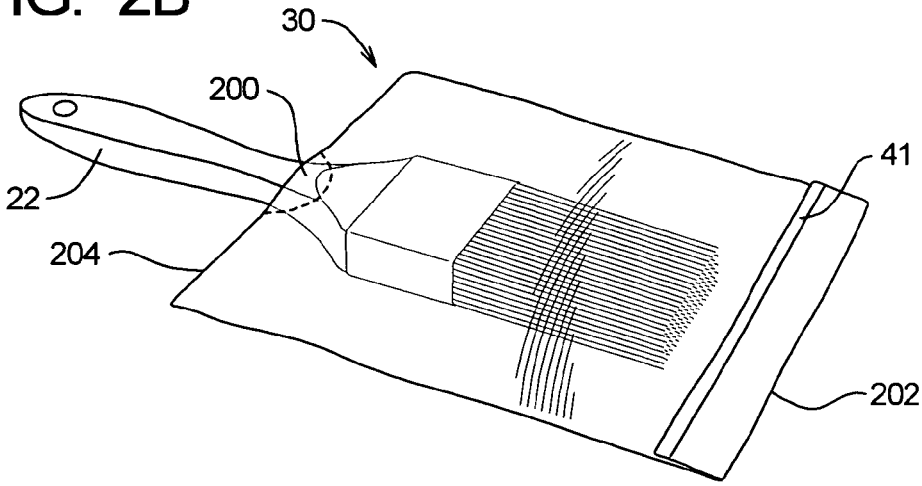
FIG. 2B is an isometric view of a paint brush contained within a protective environment, with the handle protruding through an optional perforated handle opening.

Referring briefly to FIG. 2*b*, an alternative embodiment of the protective environment 34, the wet paintbrush 22 is shown with a perforated handle opening 200 located in the rearward end 204 of the protective opening. The flap system 41 is closed over the forward end of the protective environment 202, thus sealing off the enclosure. In operation, the wet paintbrush 22 is inserted handle first through the forward end 202 of the protective environment. The handle is then punched through the perforated handle opening 200 and extends out there from. The brush itself is kept within the protective environment confines and the flap system 41 is folded over to be sealed onto the front wall of the protective environment 30. Thus in both the current embodiment and the alternative embodiment, the inner portion of the protective environment 30 acts as a chamber region 48 as seen in FIG. 4, into which the paint applicator 18 is inserted.

Still referring to FIGS. 1, 2, and 4, if the paint brush 22, after being inserted into the protective environment 30 has a portion of its bristle head 36 not covered by the protective membrane 40, then the evaporation rate will continue to proceed at the current hourly rate until the interior chamber 48 of the containing structure 40 is substantially closed off.

Figure 9:
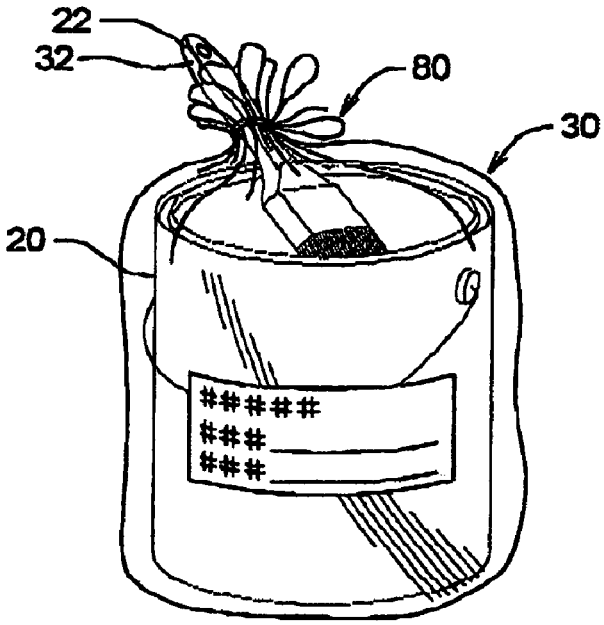
FIG. 9 is an isometric view of a paint can in combination with a paint brush contained within a protective environment.
Figure 9A:
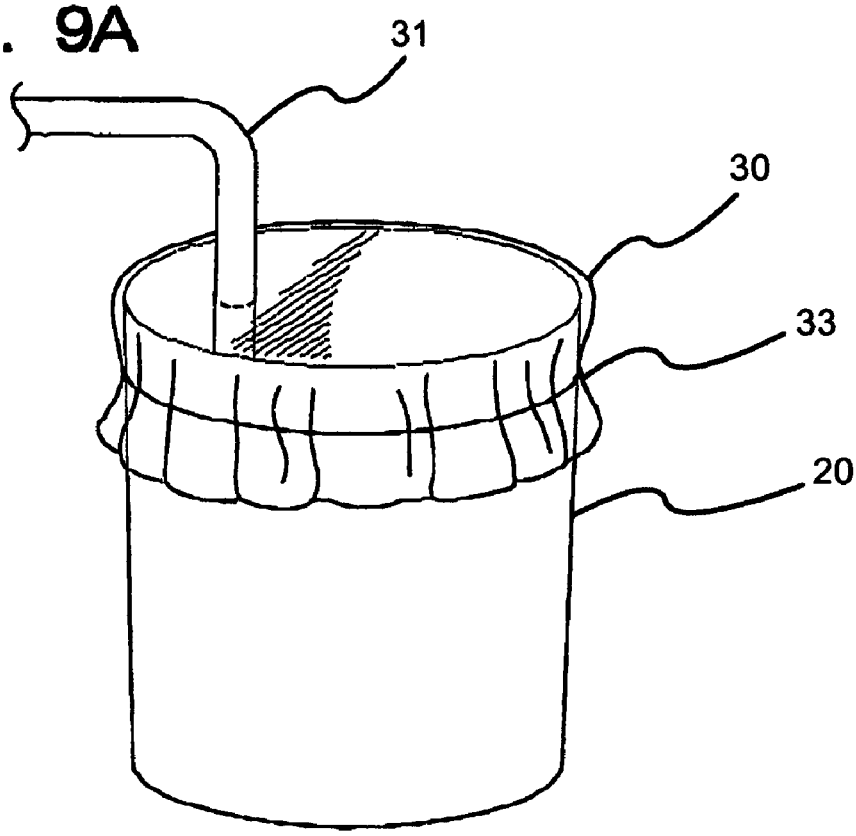
FIG. 9A is an isometric view of a paint can in combination with a paint gun tube encompassed by a protective environment with elastic bands.

To close off the interior chamber 48 of the containing structure 40 the opening 46 must be substantially fixed closed. To do this a number of configurations may be chosen, one being as is shown in FIG. 2, a corner closure system 39 to take the corner edges of the coplanar front and back wall 42*a* & *b*, and fold them around the middle portion of the paint brush handle 32. The edges may be affixed to the containing structure front wall 42*a* through the means of an adhesive tape between the interface of the front wall 42*a* and the folded corner portions as shown in FIG. 2. Additionally, referring to FIG. 7, an alternative string closure system 80 using a string 82 threaded through a plurality of holes in the edge portion of the opening 46 will allow the user to tighten the string 82 and restrict the open area of the opening 46 to substantially fit the cross-sectional area of the handle 32 if for example, the painting applicator is a paint brush 22 or a paint roller 24. Still other enclosure systems can be utilized including a zipper-type closure system such as the Ziploc™, a hook and loop fastener system such as the Velcro™, and other closure systems such as a button or snap-in place like mechanical system. Additionally, when utilizing a containment structure around a paint pail or gallon of paint, as seen in FIG. 9A, the closure system may include an elastic band 33 around the bottom perimeter of the containment structure 30 enabling the top of the opened paint can 20 to be substantially closed around a a paint gun tube 31.

Similar to the corner closure system 39, a flap system 41 can be employed where the back wall 42*b* of the containing structure has a lip which extends laterally rearward above the opening 46, and the lateral extension has lateral flap portions 31*a* and 31*b* where contained on the lateral flap portions is an adhesive strip 33. The adhesive properties for the lateral flap portions 31*a* and 31*b* are such that they can be reapplied a multitude of times to the containing structure 40.

Using the above conceived embodiments, the containing structure 40 can be nearly completely hermetically sealed around the painting applicator 18. Thus the inner chamber region volume 48 will reach a relatively stable vapor state to liquid state ratio and not lose additional water vapor to the outside painting environment 10.

In the current embodiment, the containing structure 40 material is a translucent or transparent polyvinyl chloride or can be a comprised of a noncorrosive flexible composition such as comprised of an inner noncorrosive lining and an outer shell.

Figure 3:
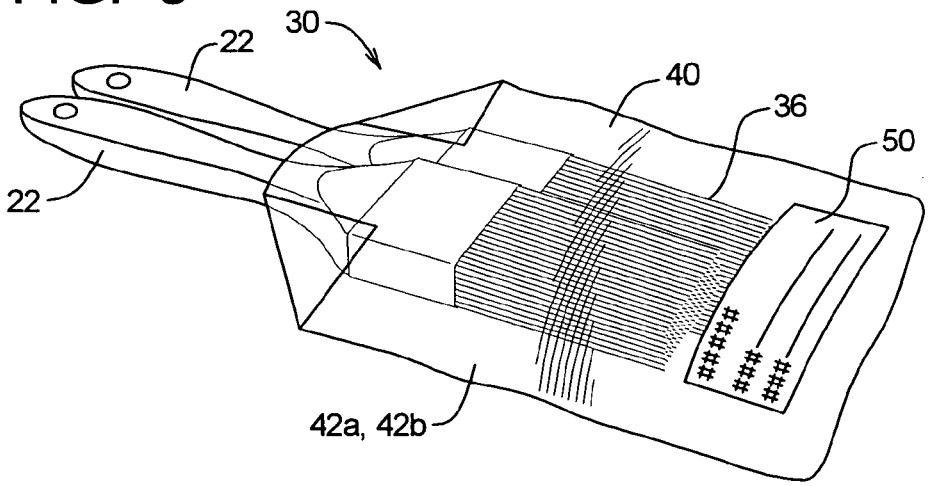
FIG. 3 is an isometric view similar to FIG. 2, with two paint brushes having wet paint on the bristles and contained within a typical protective environment.

It is conceivable that the painter may want to group paint applicators 18 such as paint brushes 22 and or paint rollers 24 together if they have the same paint specifications and the same protective environment 30. For this reason, the protective environment 30 is provided with enough of a chamber region volume 48 to accommodate more than one paint applicator 18. For example, referring to FIG. 3, two paint brushes 22 are shown encompassed in a containing environment 30. The paint brushes 22 have wet paint on them and have been sealed in the containing structure 40. In this arrangement, the paint brushes 22 are staggered on top of each other and the front and back wall's 42*a*, and 42*b*, are pressed against the exposed brush surfaces of the paint brush bristles 36. Where the interface between the membrane 40 and the wet paint brush bristles 36 ceases, the hermetically sealed closure also ceases. Thus, the additional containing chamber 48 volume not in contact with the viscous paint 28 will capture the evaporating water vapor from the paint 28 and as previously discussed, the evaporation rate for that portion of the exposed paint 28 will stabilize within the containing chamber 48.

Attached or imprinted to the outside face of the front wall 42*a* is an identification label or printing 50. Referring to FIG. 2*a*, the identification label 50 is composed of a number of preprinted fields 52. Also included is space for advertising 54 and trademark labeling 56. The preprinted fields 52 provide the paint user the opportunity to identify the type of surface treatment or paint 28 contained within the paint applicator 18 and covered by the containing structure 40. These preprinted fields may vary by industry. Thus because of the surface treatment needs, the timing, treatment characteristics, locations and contained applications may all change for a specific industry job. For example, in the residential construction industry, the paint characteristic fields 58 such as flatness or varnish or interior/exterior uses can be identified through the marking of the paint characteristic fields 58 corresponding to the check boxes 60 on the preprinted label 50. Additionally, coordination of the paint applicator 18 with the current painting environment 10 can be labeled in the painting environment field 62 which in this instance is shown as "room". Also, the type of surface such as a wall 12, molding 14, or other painted surface can be specified in the surface field 64. The painter can also include the date of the last use in the date field 66, the color code of the paint in the color code field 68 the paint manufacturer in the paint manufacturer Field 70 and the area painted in the area painted field 72. Also, notes can be recorded in the Notes field 74.

As previously mentioned, the information in the fields 52 contained within the label 50 can be applied directly to the outside wall of the containing structure 40. In such an embodiment, the portion of the containing structure having the printed information 50 would be opaque so that the writings and markings on the fields 52 would be readable.

With the containing structure 40 elements described above, it will be beneficial to provide a discussion of the use of the protective environment 30 within a painting process.

Referring to FIG. 1, as previously discussed, we see the painting environment 10 with the various paint applicators 18 covered by the various sizes of protective environments 30. Generally after finishing painting a particular area, the painters will have leftover paint 28 on the paint applicators 18. To efficiently finish the portion of the job, and help keep the paint applicators 18 in-stasis or in the presently used condition, the painters will cover the paint applicators 18 with the protective environments 30. For example, the painter may have a paint brush 22 as shown in FIG. 2, through which he will want to keep the current paint 28 on the paint brush because he is going to be using it later in the paint process. Consequently the painter will choose a protective environment 30 configured for a paint brush 22. In this particular embodiment the protective environment 30 is approximately 3½ inches, by 6 inches in rectangular shape. The painter will insert the paint brush bristles 36 into the inner chamber region 48 of the protective environment 30. The painter will then press down on the containing structure 40 of the protective environment 30 and force the membrane 40 or containing structure 40 to come in contact with the wet paint 28 still applied to the bristles 36. Additionally, the user will force the remaining air contained in the chamber region 48 out through the opening 46 at the edge or top portion of the protective environment 30.

As is shown in FIG. 2, the painter will utilize a flap closure system 41 which enables the user to effectively close off the protective environment opening 46 by wrapping the closure edge 46 around the paint brush handle 32 and affixing the lateral flap portions of the flap system 41 against the front wall 42*a* of the containing structure 40.

Figure 5:
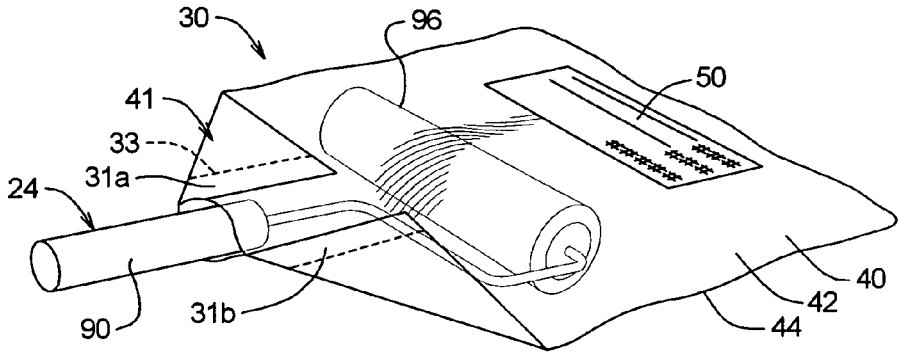
FIG. 5 is an isometric view of a paint roller contained within a typical protective environment.
Figure 5A:
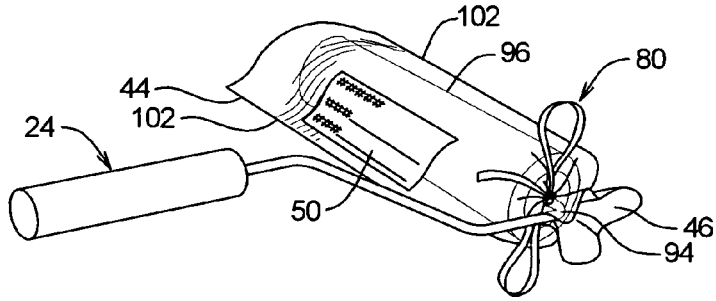
FIG. 5A is an isometric view of a paint roller contained within an alternative embodiment of the protective environment.
Figure 6:
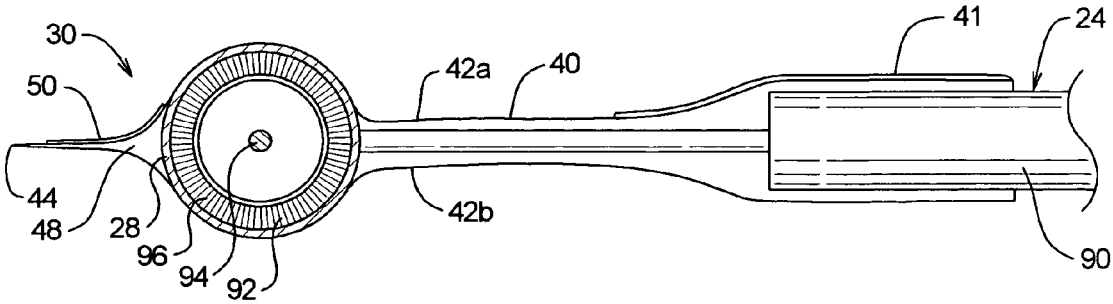
FIG. 6 is a cross-sectional view of a wet paint roller as shown in FIG. 5, with the protective environment surrounding the paint roller portion.

With the applicator 18 securely positioned within the protective environment 30, the painter will likely move onto the next applicator 18 which needs to be covered. Referring to FIGS. 5, 5*a*, and 6, the painter will likely have in his possession a paint roller 24 which also has wet paint 28 on it. To preserve this paint applicator 18 in its used state, the painter will acquire a protective environment 30 which is configured to cover a paint roller 24. FIG. 5 shows a large containing structure 40 configured to hold one or more paint roller 24. In FIG. 5 a single paint roller is shown. Similar to the process of protecting the paint brush 22 above, the painter will insert the wet portion of the paint roller 24 which includes the paint roller applicator portion 96 into the inner chamber 48 of the protective environment 30. The paint roller applicator portion 96 further has a handle portion 90.

The painter will again use a flap system 41 to secure the inner chamber portion 48 of the protective environment 30 so that evaporation of the wet paint 28 does not occur. The painter will then perform an air removing process where he forces the air out of the containing region 48 and presses the membrane 40 of the protective environment 30 against the wet paint portions of the paint roller applicator 96. With the membrane fully secured against the wet paint 28 through viscosity holding both the membrane to the paint and the paint to the nap 92 of the paint roller applicator 96, the wet paint 28 is adequately protected for future use.

As an alternative embodiment and referring to FIG. 5*a*, an elongated protective environment 30 is shown covering just the paint roller applicator 96 of the paint roller 24. The paint rollers themselves have a cylindrical application area and the alternative embodiment is designed with somewhat of a cylindrical volume to encompass the entire applicator shaft. In lieu of a cylindrical body for the elongated protective environment, the membrane can be constructed of a two-piece flat wall system which is as previously discussed connected along three of the perimeter edges 102 and having adequate volume to encompass the cylindrical paint roller applicator 96. Having a flat wall membrane construction enables more efficient production techniques.

As previously discussed, closure systems used can include a zipper, a Ziploc™-type mechanism, a Velcro™ or a hook and loop type fastener system, a glue adhesive-type system, and a string closure system. Although in the current embodiment a flap closure system 41 is currently used, a string closure system 80 can be alternatively used where the open portion of the containing region 48 is tightened around the roller shaft 94 to adequately seal the inner chamber region 48 from the outer painting environment when sealing a paint roller.

Figure 7:
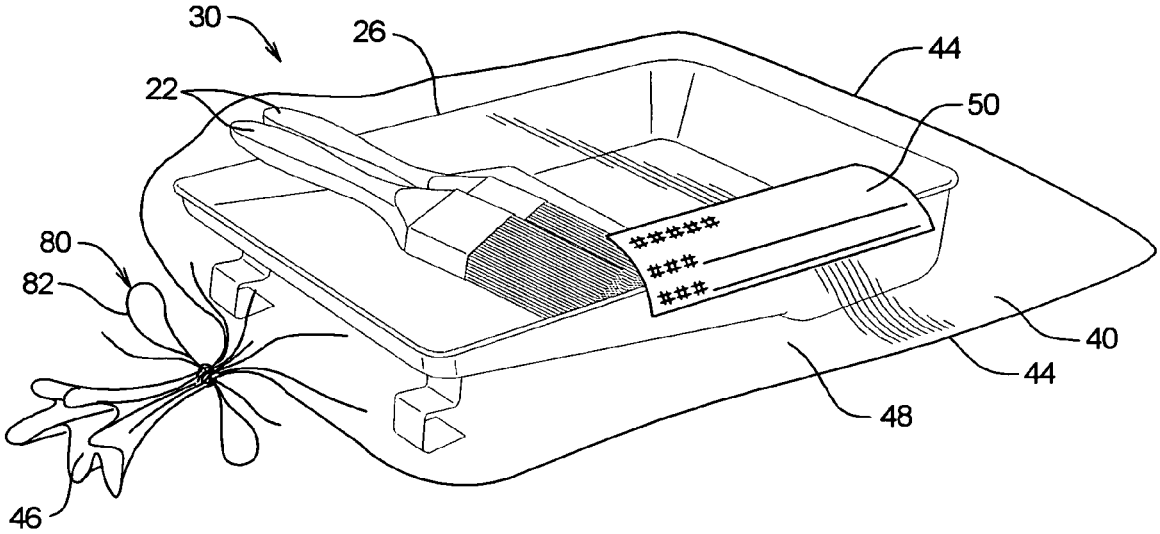
FIG. 7 is an isometric view of a paint tray contained within a protective environment.

Additionally, the painter may wish to cover the paint tray 26 with a protective environment 30. Referring to FIG. 7, the painter can use a larger protective environment 30 substantially configured to cover an entire paint tray 26. Similar to the configuration of the protective environments 30 covering both the paint roller 24 and the paint brushes 22, the protective environment 30 covering the paint tray 26 is shown as a generally rectangular containing structure having three connecting edges 44 with an inner chamber region 48 and a containing structure 40 or membrane 40 having a thickness of at least ½ mil. In this particular embodiment, a pair of paint brushes 22 are included within the protective environment 30 along with the paint tray 26, but in other uses, the paint brushes 22 may be left out of the paint tray protective environment 30. The paint tray 26 also holds wet paint 28 within its tray portion. The painter will insert the paint tray 26 holding the wet paint 28 into the protective environment 30 and seal the inner chamber region 48 from the outer painting environment 10 by tightening the sealing system such as the string closure system 80 provided at the opening portion 46 of the protective environment 30.

Figure 8:
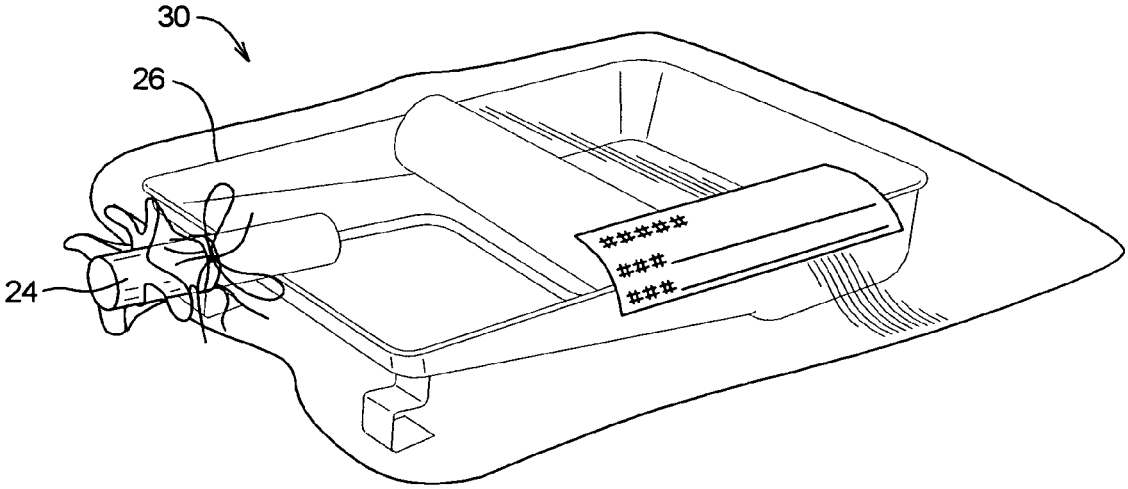
FIG. 8 is an isometric view of the paint tray in combination with a paint roller both contained within a protective environment.

An alternative use of the paint tray protective environment 30 is shown in FIG. 8. Here, a number of paint applicators are contained within the protective environment 30 including a pair of paint brushes 22, a paint roller 24, and a paint tray 26. Lastly, it is conceivable that the painter could have misplaced the paint can top and thus need to utilize a protective environment 30 to cover a paint can 20. Referring to FIG. 9, the painter will acquire a protective environment 30 configured to cover or encompass a paint can 20. Utilizing the same method of closure system as was shown for the paint tray 26, the paint can protective environment 30 will utilize in this particular embodiment, a string closure system 80 which is shown closed around the handle 32 of a paint brush 22 also being contained within the protective environment 30 covering the paint can 20. In an alternative embodiment, the paint brush 22 is not contained in the paint can protective environment 30.

With all of the painting applicators 18 covered or protected from the painting environment 10 through the use of protective paint environments 30, the user or painter will want to coordinate the various paint applicators 18 as well as identify the contents of the protective environments 30. Each protective environment 30 has connected to it a coordination, identification, or guide system 50, which provides for a way of identifying the contents held within the protective environments 30, as well as the characteristic uses of the various painting applicators 18 and paint 28 held within each of the protective environments 30.

Referring to FIG. 2*a*, the painter will utilize the identification fields 52 provided for on the outer wall or front wall 42*a* of the containing structure 40 of each of the protective environments 30.

For example, the paint brush protective environment 30 as shown in FIG. 2, may have connected to it, a type of wet paint 28 which can be identified as a flat white paint for interior use within the living room of the house being painted. For example, the paint manufacturer may be Ralph Lauren, and the area being painted could be the north living room wall. Also the last date of the paint brush being used could be Sep. 10, 2004. This information can be efficiently organized in the identification or specification system 50 provided for on the protective environments 30. The painter can then efficiently organize the various painting applicators 18 and group them together for later use.

Thus the painting applicators 18 have been stored and protected in protective environments 30 for efficient reuse in the second or third coat of paint, or in being used in a different location of the house or painting job utilizing the same paint specifications.

We claim:

1. A protective environment for a paint applicator away from a natural environment, said paint applicator being used by a paint user, the protective environment comprising:

a) at least one paint applicator comprising a handle portion and a paint carrying portion coupled thereto, said paint carrying portion comprises an outer surface portion and an inner volume portion holding wet paint that has a viscosity;

b) a containing structure comprising a plurality of containing walls that define a containing chamber, said plurality of containing walls comprise an inner surface and an outer surface, said inner surface is directly coupled to said paint carrying portion such that said containing structure facilitates protecting said paint applicator from a natural environment and facilitates conforming to the shape of said paint applicator;

c) an identification label coupled to said outer surface of said containing structure, said identification label comprising a plurality of preprinted fields comprising preprinted characteristics of said wet paint coupled to said paint carrying portion of said paint applicator, wherein said preprinted characteristics enable a user to place a mark adjacent a corresponding characteristic in at least one of said plurality of preprinted fields;

d) wherein said containing structure facilitates housing said paint applicator therein such that said wet paint is sealed off from the natural environment.

2. The apparatus according to claim 1 wherein said containing structure further comprises an access opening and a closure portion, wherein said access opening enables said paint applicator to be inserted into said containing chamber and said closure portion facilitates sealing said paint applicator within said containing structure.

3. The apparatus according to claim 1 wherein said plurality of containing walls further comprise a wall thickness sized to enable said containing structure wall to conform to a general shape of said paint applicator coupled therein.

4. The apparatus according to claim 1 wherein said containing structure further comprises a unit weight light enough to enable the viscosity of said wet paint to facilitate coupling said paint applicator to said inner surface of said plurality of containing walls.

5. The apparatus according to claim 1 wherein said containing chamber further comprises a predetermined interior volume, said interior volume facilitates substantially reducing a wet paint evaporation rate to substantially zero.

6. The apparatus according to claim 1 wherein said plurality of preprinted fields further comprise surface treatment characteristics for surface treatment compounds.

7. The apparatus according to claim 1 wherein said plurality of preprinted fields further comprise:

a) a plurality of surface treatment characteristics found within the paint industry including at least paint types, stain types, varnish types, and other types of surface treatment;

b) a plurality of wet paint characteristics including inferior paint, exterior paint, latex paint, oil-based paint, flat finishes, gloss finishes, semi-gloss finishes, satin finishes, and other paint finishes;

c) a plurality of environment characteristics including exterior, interior, bedroom, master bedroom, bathroom, master bathroom, living room, office, attic, den, hallway, patio, entryway, basement, foyer, kitchen, laundry room, closet, back yard, front yard, side yard, first floor, second floor, third floor, front desk, office number, workspace, break room, conference room, administration, research, and other living or working environments;

d) a plurality of surface characteristics including body, trim, doors, windows, ceilings, walls, and other areas; and e) a plurality of paint applicator characteristics including paint tray, paint brush, paint roller, paint pails, paint guns.

8. The apparatus according to claim 1 wherein said containing structure is further comprised of a noncorrosive flexible composition.

9. The apparatus according to claim 8 wherein said noncorrosive flexible composition is further comprised of an inner noncorrosive lining and an outer shell.

10. The apparatus according to claim 1 wherein said containing structure is further comprised of a transparent polyvinyl chloride.

11. The apparatus according to claim 1 wherein said containing structure is further comprised of a translucent polyvinyl chloride.

12. The apparatus according to claim 1 wherein said containing structure is further comprised of an opaque polyvinyl chloride.

13. The apparatus according to claim 1 wherein said containing structure is further comprised of a polyvinyl chloride having a wall thickness not less than ½ mil.

14. The apparatus according to claim 1 wherein said identification label further comprises a plurality of indication boxes coupled to said outer surface of said containing structure, said plurality of identification boxes are positioned adjacent said preprinted characteristics of said plurality of preprinted fields and enable the user to place a mark in said indication box of at least one of said preprinted characteristics.

15. The apparatus according to claim 7 wherein said preprinted characteristics are recorded onto said plurality of preprinted fields imprinted onto said outer surface of said containing structure.

16. The apparatus accordingly to claim 1 wherein said containing structure further comprises a containing chamber sized to house at least one of a paint tray, a paint brush, paint roller, paint pail, and a paint gun.

* * * * *